United States Patent [19]

Ottowell

[11] Patent Number: 4,595,090

[45] Date of Patent: Jun. 17, 1986

[54] DEVICE FOR CHANGING MODEL PLATES IN MOLDING MACHINES

[75] Inventor: Rüdiger Ottowell, Bochum, Fed. Rep. of Germany

[73] Assignee: Georg Fischer AG, Schaffhausen, Switzerland

[21] Appl. No.: 537,405

[22] PCT Filed: Dec. 23, 1982

[86] PCT No.: PCT/CH82/00137

§ 371 Date: Sep. 16, 1983

§ 102(e) Date: Sep. 16, 1983

[87] PCT Pub. No.: WO83/02410

PCT Pub. Date: Jul. 21, 1983

[30] Foreign Application Priority Data

Jan. 19, 1982 [DE] Fed. Rep. of Germany ..... 3201447

[51] Int. Cl.[4] ..... B65G 47/00; B29C 33/34

[52] U.S. Cl. ..... 198/346.2; 164/44; 164/325; 249/104; 425/182

[58] Field of Search ..... 264/509; 425/182, 403, 425/385, 441, 443, 185; 249/103, 104; 164/44, 325, 326, 37, 40, 324, 327; 198/346.2, 346.3

[56] References Cited

U.S. PATENT DOCUMENTS 3,802,487 4/1974 Feller ..... 164/37
4,111,624 9/1978 Hanson ..... 425/385

FOREIGN PATENT DOCUMENTS 1030526 5/1958 Fed. Rep. of Germany .
1223507 8/1966 Fed. Rep. of Germany .
3022651 2/1981 Fed. Rep. of Germany .

*Primary Examiner*—Willard E. Hoag
*Attorney, Agent, or Firm*—Roylance, Abrams, Berdo & Goodman

[57] ABSTRACT

A device for changing model plates is used in the manufacture of sand molds for foundry molding machines. The vertical axis of the lifting mechanism intersects both the longitudinal axis of the feed mechanism and the pivot field circle of the rotary conveyor for moving the model plates between lifting and molding sites. Model plates can be changed by the device without interrupting the molding machine cycle. Also, the model plates can be positioned outside the molding machine.

13 Claims, 1 Drawing Figure

DEVICE FOR CHANGING MODEL PLATES IN MOLDING MACHINES

FIELD OF INVENTION

The present invention relates to a device for changing model plates in molding machines, in which each model plate is conveyed from a lifting site on a pivoting plate or turnstile to a model plate carriage.

BACKGROUND OF THE INVENTION

A number of devices are known for changing model plates in which the model plates are moved by a transverse movement of a storage site element into the molding machine. Other arrangements involve a pivoting plate or turnstile, wherein a model carrier is removed from a magazine and is exchanged with a model carrier found in the molding machine during an interruption of the cycle of the molding machine.

Other arrangements are known wherein a mechanism is inserted between the pivoting plate and the model plate storage site. Model plates are picked up by the mechanism from the pivoting plate and are moved into the storage site. For example, DE-OS No. 30 22 651 discloses a system with a lifting cylinder mounted on a frame. On the piston rod of the lift cylinder a lifting frame is arranged and has vertical step cylinders. Four openings are in a model plate carrier, preferably in one orthogonal grid per model plate element. The number of and the grid dimensions of the step cylinders are synchronized with the arrangement of the openings.

A disadvantage of this arrangement is that a plurality of devices must be used in coordination for any one model plate exchange, which coordination is very costly. Also, the arrangement can become polluted such that precise positioning of the model plates is no longer guaranteed.

SUMMARY OF THE INVENTION

Objects of the present invention are to eliminate the disadvantages of conventional systems and to provide a system wherein prepared model plates can be changed without interruption of the cycle of the molding machine and wherein the model plates can be positioned outside the molding machine.

The foregoing objects are basically obtained by an apparatus for changing model plates in a molding machine. The apparatus comprises a feed mechanism with carriages for conveying plates in a horizontal direction on the carriages, a rotatable conveyor for horizontally moving model plates between lifting and molding sites along a pivot field circle, and a lifting mechanism at the lifting site. The lifting mechanism moves the model plates between the lifting site on the rotatable conveyor and one of the feed mechanism carriages along a vertical axis intersecting the pivot field circle and the longitudinal axis of the carriages.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawing which forms a part of this disclosure and which is a perspective view schematically illustrating an apparatus for changing model plates in a molding machine according to the present invention.

DETAILED DESCRIPTION OF PREFERRED EMBODIMENT

Figure 1:
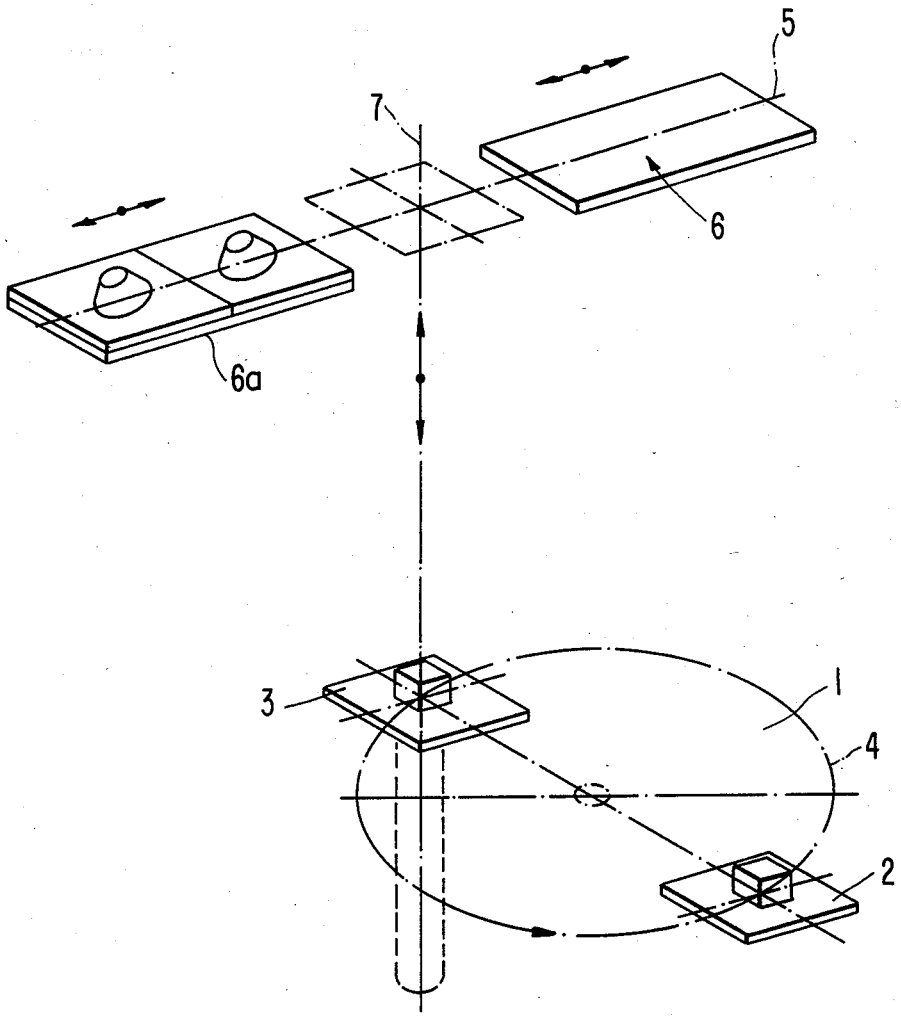

The drawing diagrammatically illustrates a pivoting plate 1. Position 2 is the position of the model plate in the molding machine. Position 3 shows the model plate outside the molding machine, and coincides with the position of a lifting site. The lifting site mechanism has a lifting table which can be moved vertically by means of a cylinder arrangement.

The movement can be controlled pneumatically, hydraulically, or electromechanically. Driven rollers can be arranged on top of the lifting table. The dimensions of the driven rollers are adapted to the model plates. The lifting site has a bottom position in which its vertical axis intersects the pivot field circle 4 of pivoting plate 1. The top position of the lifting site is in the area of a model plate feed device 6. The feed device axis 5 runs horizontally through the vertical axis of the lifting device site.

The feed device essentially consists of at least two model plate carriages 6*a* provided with driven rollers. These driven rollers hold the model plates. Thrust pistons can be provided on the bottoms of the model plate carriages to move these carriages into the area of the lifting table.

The device operates as follows. During or following the production of a mold, the model plate found in the bottom position 3 of the lifting site is picked up from the lifting site and thrust into the top position at the level of the axis 5 of the feed device. Two model carriages are brought simultaneously into the area of the top lifting site by means of a thrust piston drive.

In this position, the model plate is moved by the rollers in the lifting table onto a waiting empty one of the model carriages. A waiting model plate rolls simultaneously over the driven rollers of the other model carriage onto the rollers of the lifting table. Subsequently, both model carriages return to their starting positions, and the lifting table with the model plate thereon is lowered into the pivot area of pivoting plate 1.

Then the model plate in the molding machine can be changed by movement of the pivoting table.

While a particular embodiment has been chosen to illustrate the invention, it will be understood by those skilled in the art that various changes and modifications can be made therein without departing from the scope of the invention as defined in the appended claims.

I claim:

1. An apparatus for changing model plates in a molding machine, comprising:

feed means, including carriages, for conveying model plates in a horizontal direction on said carriages, said carriages having a longitudinal axis;

rotatable conveyor means for horizontally moving model plates between a lifting site and a molding site and along a pivot field circle; and lifting means, at said lifting site, for moving model plates between said lifting site on said rotatable conveyor means and one of said carriages of said feed means along a vertical, axis intersecting said longitudinal axis and said pivot field circle.

2. An apparatus according to claim 1 wherein said vertical axis of said lifting means intersects said longitudinal axis of said carriages at a right angle.

3. An apparatus according to claim 2 wherein said longitudinal axis of said carriages corresponds to the longitudinal axis of said feed means.

4. An apparatus according to claim 1 wherein said longitudinal axis of said carriages corresponds to the longitudinal axis of said feed means.

5. An apparatus according to claim 4 wherein said rotatable conveyor means comprises a planar support surface in the plane of said pivot field circle with means for supporting a model plate, said vertical axis being perpendicular to said support surface.

6. An apparatus according to claim 3 wherein said rotatable conveyor means comprises a planar support surface in the plane of said pivot field circle with means for supporting a model plate, said vertical axis being perpendicular to said support surface.

7. An apparatus according to claim 2 wherein said rotatable conveyor means comprises a planar support surface in the plane of said pivot field circle with means for supporting a model plate, said vertical axis being perpendicular to said support surface.

8. An apparatus according to claim 1 wherein said rotatable conveyor means comprises a planar support surface in the plane of said pivot field circle with means for supporting a model plate, said vertical axis being perpendicular to said support surface.

9. An apparatus according to claim 8 wherein said feed means comprises means for interchanging model plates reciprocally.

10. An apparatus according to claim 5 wherein said feed means comprises means for interchanging model plates reciprocally.

11. An apparatus according to claim 3 wherein said feed means comprises means for interchanging ' model plates reciprocally.

12. An apparatus according to claim 2 wherein said feed means comprises means for interchanging model plates reciprocally.

13. An apparatus according to claim 1 wherein said feed means comprises means for interchanging model plates reciprocally.

* * * * *